United States Patent [19]

Santen et al.

[11] 3,970,290

[45] July 20, 1976

[54] ARRANGEMENT FOR FEEDING

[75] Inventors: Sven Santén, Hofors; Carl Erik Grip, Lulea, both of Sweden

[73] Assignees: SKF Industrial Trading and Development Company, B.V., Jutphaas, Netherlands; Norrbottens Jarnverk AB, Lulea, Sweden; part interest to each

[22] Filed: Mar. 11, 1974

[21] Appl. No.: 449,784

[30] Foreign Application Priority Data

Mar. 26, 1973 Sweden ..... 7343333

[52] U.S. Cl. ..... 266/138; 13/9 R; 75/11; 75/42; 266/267

[51] Int. Cl.[2] ..... F27B 1/16

[58] Field of Search ..... 75/41, 42, 11; 266/41, 266/29, 30; 13/9

[56] References Cited

UNITED STATES PATENTS

| | | | |
|---|---|---|---|
| 975,625 | 11/1910 | Martin | 75/42 |
| 1,393,749 | 10/1921 | Carstens | 75/42 |
| 3,558,791 | 1/1971 | Grachev | 13/9 |

FOREIGN PATENTS OR APPLICATIONS

| | | | |
|---|---|---|---|
| 1,314,039 | 4/1973 | United Kingdom | 75/11 |

OTHER PUBLICATIONS

Tyler, P. M., Journal of Metals Jan. 1961, pp. 51–54.

*Primary Examiner*—M. J. Andrews
*Attorney, Agent, or Firm*—Daniel M. Rosen

[57] ABSTRACT

A method of increasing the blast temperature in a shaft furnace, characterized in that the blast gas entirely or partially is passed through a plasma.

5 Claims, 3 Drawing Figures

ARRANGEMENT FOR FEEDING

This invention relates to a method and an arrangement for rendering it possible to substantially increase the blast temperature for a shaft furnace, preferably a blast furnace, whereby the amount of desirable additives, e.g. oil, pulverized coal or water vapour on the tuyere level can be increased substantially and a considerable saving in metallurgical coke and an increase in output can be achieved.

It is known since a long time ago to decrease the coke consumption and increase the production in a blast furnace by increasing the blast temperature. At blast temperatures above 850°C, moreover, oil can be injected into the tuyeres and thereby contribute to an additional coke saving. The yield value for oil is for the first oil addition about 2 kg coke per kg oil. This value, however, decreases at increased oil addition and constant blast temperature to a value of about 1 kg coke per kg oil. A further increase in oil addition over a certain amount is not possible as this would result in too low a combustion temperature in front of the tuyeres and, besides, imply a lower output.

The aforesaid circumstances make it desirable to increase the blast temperature to the highest possible degree. In conventional arrangements for this purpose, however, e.g. in the so-called Cowper-apparatus, the temperature is limited to about 1100°C. Even if the Cowper-apparatus per se would be capable of effecting higher temperatures, such an increase in temperature would be expensive as it requires the use of a fuel richer than top gas and as the efficiency degree of a flame at this temperature is relatively low.

Another method of increasing the combustion temperature is by means of oxygen enriched blast. Oxygen, however, is relatively expensive and, besides, there is also a limit to such enrichment, viz. where the specific gas amount becomes too small for being capable of transporting the necessary heat upwards through the shaft. One example of an extensive oxygen enrichment is a plant having obtained the values as follows: coke consumption about 400 kg/t, oil 100 – 150 kg/t, oxygen 60 – 100 $Nm^3$/t of pig iron.

It is theoretically possible to replace all coke with oil by increasing the blast temperature as the oil amount increases. At a coke amount below 150 – 200 kg per ton of pig iron, however, the coke will not be sufficient for the reaction $CO_2 + C \rightarrow 2\ CO$ in the shaft centre, and the entire mode of operation of the blast furnace will change and be more like that of the sponge iron furnace. The effect of increasing the blast temperature to 1400° – 1500°C is known through experiments and the literature, see e.g. W. A. Knepper, P. L. Wolf, H. R. Sanders: Operation of Bureau of Mines experimental blast furnace with fuel oil injection, Blast furnace, Steel Plant 49(1961) pages 1189–1196, and Bogdandy, Engell: The reduction of iron ore, Düsseldorf 1971. Up to said temperature range the possible amount of injected oil and the production increase are proportional to the temperature. This proportionality can be expected to maintain until one of the following cases occurs:

a. the coke amount is so low that it is not sufficient for the reaction $CO_2 + C \rightarrow 2\ CO$, which will be the case at a coke amount of 200 – 250 kg/t of pig iron.

b. the coke amount is so low that the permeability in the furnace without appendices is seriously deteriorated. According to experiments, this will occur at a coke amount of 200–300 kg/t of pig iron.

c. the injected oil amount is so great that it cannot be gasified and is combusted partially in the limited available space, i.e. in the cavity in front of the tuyeres.

According to these three cases, the proportionality between blast temperature, possible amount of injected oil and production increase can be assumed to remain substantially unchanged up to a blast temperature of 1600°– 1800°C. At a further increase of blast temperature and oil amount the mode of operation of the furnace will be more like that of a sponge iron furnace and considerable difficulties should arise in the fusion zone.

In the present situation the most interesting feature in conjunction with increased blast temperature is increased oil injection. The higher blast temperature, however, renders it also possible to inject other fuels, such as coal or pulverized coke, oil slurry of coal or coke, natural gas, coke-oven gas etc. Other interesting additives on the tuyere level in connection with high blast temperatures are oxidic materials such as water, iron ore, flue gas substance and pre-reduced iron oxides as well as slag formers.

The method and arrangement according to the present invention render it possible to feed additional fuel to the tuyere level in a shaft furnace and to burn it completely there. The characterizing features of the invention will appear in the accompanying claims. At the passage through a plasma, an extremely high gas temperature can be achieved. The plasma may preferably be generated in a so-called plasma burner, which per se is known for use in other connections. In a plasma burner the plasma is generated in the gas proper passing through the burner. The efficiency degree of the plasma burner is 75 – 85 % and relatively independent of the temperature. The temperature usually obtained in a gas leaving a plasma burner is between 3000° and 4000° centigrade. By directly exposing the additional fuel to this high temperature a very quick gasification is achieved which considerably accelerates the combustion of the fuel.

Since the temperature of the blast air supplied to the tuyeres can be controlled simply and efficiently by the plasma burner, a new control variable in the ironworks operation is obtained. At cold charge operation in a blast furnace, for example, the energy amount supplied through the tuyeres can be increased, whereby a substantially more rapid change in the energy balance of the blast furnace is obtained than it is possible to obtain by increasing the coke charging to the blast furnace. This latter method was normally used heretofore.

The invention is described in greater detail in the following, with reference to the accompanying drawing, in which

BRIEF DESCRIPTION OF THE DRAWINGS

FIG. 2 shows a device according to the invention, applied to a blast furnace. The figure shows the bottom part of a blast furnace, in which a plasma burner 18 is arranged in direct connection to a tuyere 2, in order fully to use the high energy intensity of the plasma for the gasification of the additional fuel, and to reduce the heat stresses in the blast pipe system. A branch 15 from a bustle pipe 16 is drawn to the tuyere 14. Of the blast air from the bustle pipe a part is directed via a pipe 17 through the plasma burner 18 having its outlet disposed in the conduit 3 and directed inwards to the tuyer 14. A fresh air conduit 5*a* may possibly open into the conduit 15 in front of the plasma burner.

Figure 3:
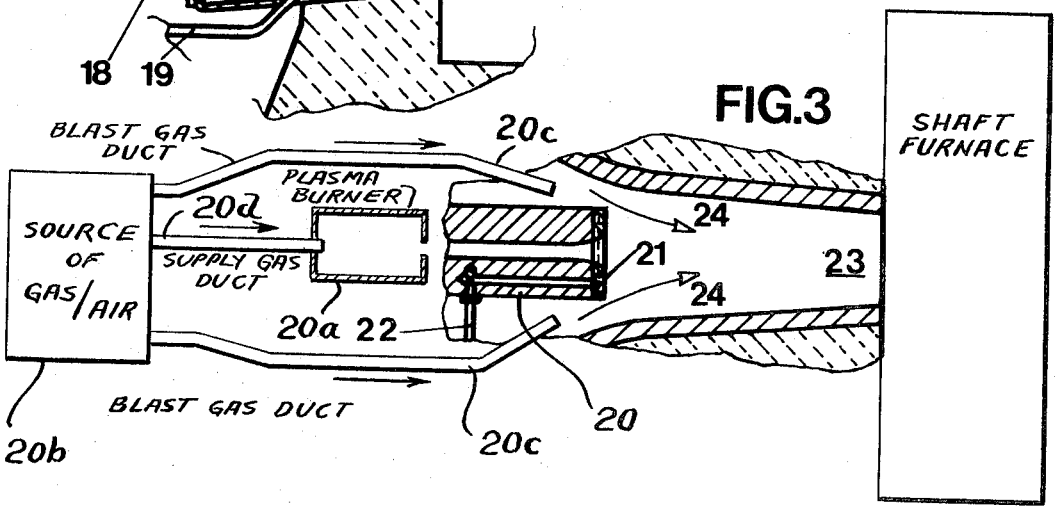
FIG. 3 is a similar view, partially schematic, showing a nozzle of this invention.

One embodiment of a nozzle for injecting additional fuel to heated air from a plasma burner according to the invention is shown in FIG. 3. About the mouth of the blow pipe 20 from the plasma burner 20*a* an annular nozzle 21 is provided for injecting, for example, oil supplied through the conduit 22. Oil and heated air from the plasma burner is mixed at the nozzle 21, and this mixture is fed to the tuyere 23 together with blast air which has not passed through the plasma burner (arrows 24).

Figure 1:
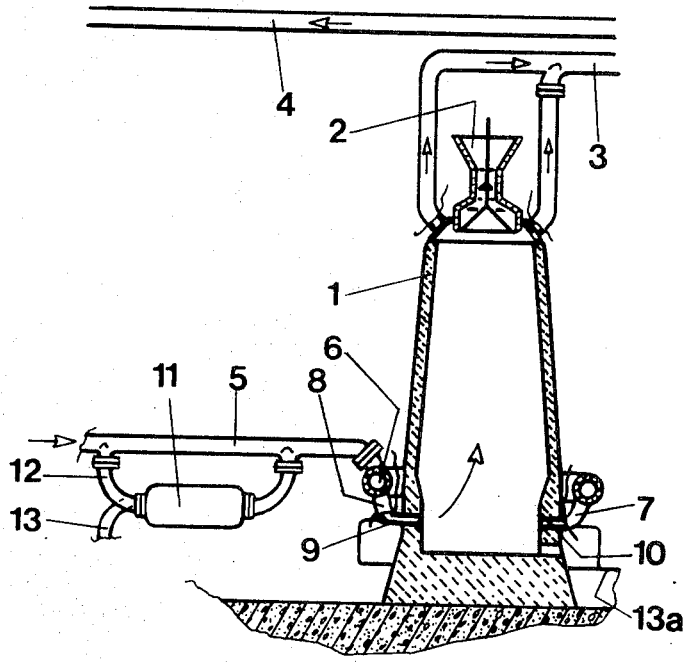
FIG. 1 is a fragmentary elevation view partly in section of one embodiment of the invention.

In FIG. 1, the invention is shown applied to a blast furnace 1 charged in the usual manner through an opening 2. The outgoing blast furnace gas is directed through the conduit 3 to a gas cleaner (not shown), from which the gas preferably is directed via the conduit to a heat exchanger (not shown), for example a so-called cowper-apparatus, and then is discharged through a chimney. The incoming, preferably preheated blast air is directed via the conduit 5 to a bustle pipe 6 disposed about the blast furnace shaft, from which pipe the air is directed into the blast furnace via a plurality of branches 7, 8 and tuyeres 9, 10.

In order to render it possible to increase the blast temperature beyond what is economically or technically possible by conventional methods, at least a part of the blast is passed through a so-called plasma burner 11, which in the embodiment shown is shunted to the conduit 5. The gas proportion passing through the plasma burner can be adjusted by a valve 12. A fresh air conduit 13 may possibly be connected directly to the plasma burner and a control valve by mounted in said conduit. Thereby the temperature and the amount of blast air to the blast furnace can be controlled accurately. A conduit 13*a* for introducing hydrocarbons, coke-oven gas, water or the like into the tuyeres is connected to the lower portion of the blast furnace.

Figure 2:
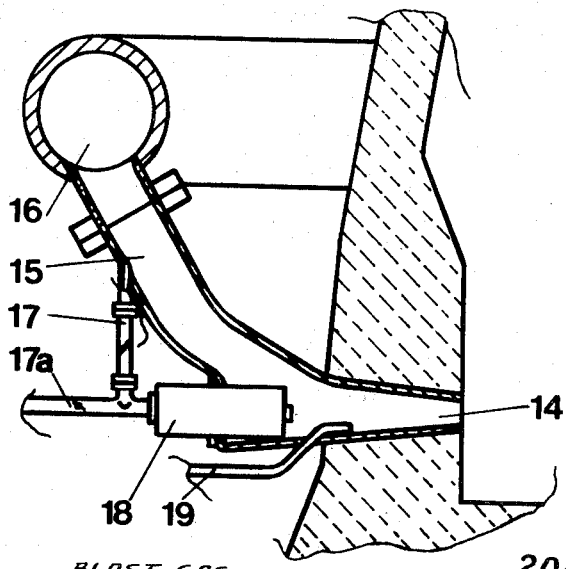
FIG. 2 is a similar view of another embodiment of the invention.

The embodiment shown in FIG. 1 is adapted for use when the blast air is not to be heated to a temperature higher than about 1500°C. At blast temperatures above about 1500°C the plasma burner preferably is positioned in direct connection to the tuyere, for example as shown at the embodiment in FIG. 2, partly in order to reduce the heat stresses in the blast pipe system and partly to reduce the heat losses. FIG. 2 shows a part of the bottom portion of a blast furnace in connection to a tuyere 7, to which a brance 15 is drawn from a bustle pipe 16 of the same kind as shown in FIG. 1 of the blast air from the bustle pipe a part is directed via a pipe 17 through a plasma burner 18 having its outlet disposed in the conduit 15 and directed inwards to the tuyere 14. A fresh air conduit 17*a* may possibly open into the conduit 17 in front of the plasma burner. A pipe 19 for the supply of, for example, hydrocarbons into the heated blast air is inserted into the conduit 15 in front of the mouth of the plasma burner, with the hydrocarbon jet directed inwards to the tuyere.

As regards the oil injection, this can in principle be carried out in the same manner as it is carried at most of today's blast furnaces. An advantageous embodiment of a nozzle for injecting hydrocarbons, coke-oven gas, water or the like as well as heated air from a plasma burner into a blast furnace is shown in FIG. 3. About the mouth of the blow pipe 20 from the plasma burner 20*a* an annular nozzle 21 is provided, which includes a plurality of holes for injecting, for example, oil supplied through the conduit 22. Oil, heated air from the plasma burner, and blast air having not passed through the burner (arrows 24) are mixed in the tuyere 23.

Blast air or blast gas is supplied from the source 20*b* by blast gas ducts 20*c*, and supply air or supply gas for the plasma burner means is provided by the supply gas duct 20*d*.

As an example of operation results possible to achieve by the present invention, the following may be mentioned. A usual type of a blast furnace has a blast temperature of 900°C, a coke consumption of 600 kg per ton of pig iron, an oil consumption of 30 kg per ton of pig iron, and an output of 50 tons per hour. When the temperature of the blast air is increased by 500°C to 1400°C by means of a plasma burner, additional 150 kg oil per ton of pig iron can be injected and thereby save 210 kg of coke per ton of pig iron. The efficiency degree being assumed to be 80%, the energy consumption in the plasma burner will be 280 kWh per ton of pig iron. The increase in the output of the blast furnace in this conjunction will be 33 %, i.e. about 17 tons per hour.

The invention, of course, can be applied also to furnaces other than blast furnaces, for example shaft furnaces for the production of foundry pig iron (cupola furnaces), lime or high-alloy pig iron, primarily iron with high chromium or manganese content.

We claim:

1. In a shaft furnace which includes a tuyere, the improvement in combination therewith comprising an apparatus operable with a source of supply gas and a source of additional fuel, for increasing the blast gas temperature and supplying and substantially completely burning said additional fuel at the tuyere level in said furnace, comprising:

a. plasma burner means for heating said gas, said plasma burner means having an inlet for receiving supply gas from said source of gas and an outlet for discharging said heated gas, and b. means for conveying said heated gas from said plasma burner means outlet to said tuyere comprising a nozzle defining i. a first passage having an inlet communicating with said plasma burner means outlet, for receiving said heated gas therefrom, and an outlet opening, ii. a fuel passage having an inlet communicating with said source of additional fuel, and an outlet formed as substantially annular opening disposed around said first passage outlet opening, and iii. a blast gas passage having an inlet for receiving gas from said source of gas and an outlet formed as a second substantially annular opening surrounding said fuel passage outlet opening, whereby said additional fuel, blast gas, and heated gas mixed in said tuyere.

2. Apparatus according to claim 1 wherein said first passage is a central duct through said nozzle.

3. In a shaft furnace which includes a tuyere, the improvement in combination therewith comprising an apparatus, operable with a source of supply gas and a source of additional fuel for increasing the blast gas temperature and supplying and substantially completely burning said additional fuel at the tuyere level in said furnace, comprising:

a. plasma burner means for heating said gas, said plasma burner means having an inlet for receiving supply gas from said source of gas and an outlet for discharging said heated gas, b. a supply gas duct for conveying gas from said source of gas to said plasma burner means inlet, c. a blast gas duct for conveying gas from said source of gas to said tuyere, and d. a fuel duct having an inlet for receiving said additional fuel from said source of fuel, and an outlet for discharging said fuel, said fuel duct outlet and said plasma burner means outlet both discharging into said blast gas duct toward said tuyere, whereby said additional fuel is mixed with said heated gas and said blast gas in said tuyere.

4. Apparatus according to claim 3 wherein said supply gas duct has an inlet communicating with said blast gas duct for receiving supply gas therefrom.

5. Apparatus according to claim 3 wherein said plasma burner means comprises second supply gas duct means for conveying fresh air to said burner means.

* * * * *